United States Patent [19]

Bourque

[11] 4,090,362

[45] May 23, 1978

[54] EXTERNAL COMBUSTION POWER CYCLE AND ENGINE WITH COMBUSTION AIR PREHEATING

[76] Inventor: Robert F. Bourque, 2756 Mission Blvd., San Diego, Calif. 92109

[21] Appl. No.: 716,973

[22] Filed: Aug. 23, 1976

[51] Int. Cl.[2] ..... F01K 13/00; F01K 15/02; F01K 17/06

[52] U.S. Cl. ..... 60/679; 60/653; 60/670

[58] Field of Search ..... 60/670, 647, 653, 643, 60/645, 679, 690, 692, 693; 431/10; 180/67

[56] References Cited

U.S. PATENT DOCUMENTS

| | | | |
|---|---|---|---|
| 3,282,048 | 11/1966 | Murphy | 60/647 |
| 3,797,248 | 3/1974 | Witzel | 60/646 |
| 3,835,650 | 9/1974 | Chesmejef | 60/670 |
| 3,848,412 | 11/1974 | Michels | 431/10 X |
| 3,893,299 | 7/1975 | Hutchinson | 60/641 |
| 3,914,091 | 10/1975 | Yamagishi | 431/10 |
| 3,940,939 | 3/1976 | Davis | 60/671 X |
| 4,023,367 | 5/1977 | Izumi | 60/693 |

*Primary Examiner*—Allen M. Ostrager
*Attorney, Agent, or Firm*—Flehr, Hohbach, Test, Albritton & Herbert

[57] ABSTRACT

A thermodynamic power cycle and engine for motive power is disclosed which uses a condensible working fluid such as water in which the pressurized fluid, after being heated to vapor, is expanded to perform work in two or more stages with low expansion ratios per stage. The working fluid is reheated between one or more of the expansion stages with short reheats having high average heat addition temperatures. For use with a positive-displacement expander, the fluid has suspended in it a finely-divided powdered lubricant, such as calcium difluoride, which is used to lubricate all wear surfaces. After the fluid leaves the expander, it is still superheated and is desuperheated prior to condensing by transferring its energy to the combustion chamber inlet air. This air preheating reduces the fuel quantity required and facilitates the use of difficult-to-burn fuels such as coal dust. The combustion of the fuel and air preferably proceeds to two steps: the first overly rich and the second very lean.

5 Claims, 12 Drawing Figures

FIG. — 1
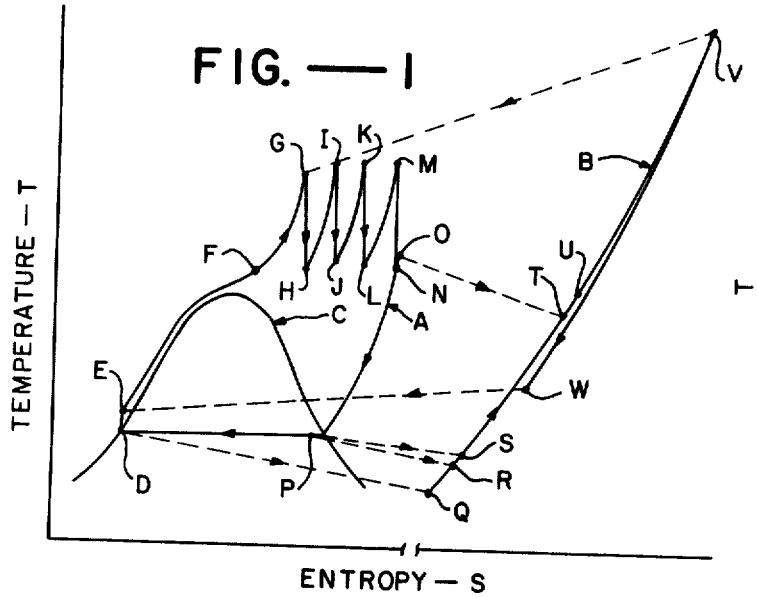
FIG. — 2
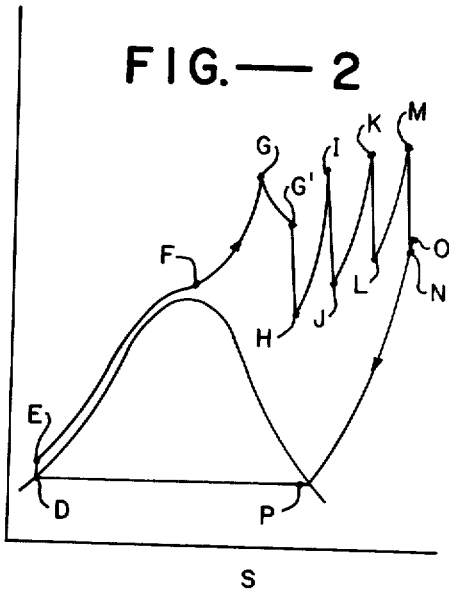
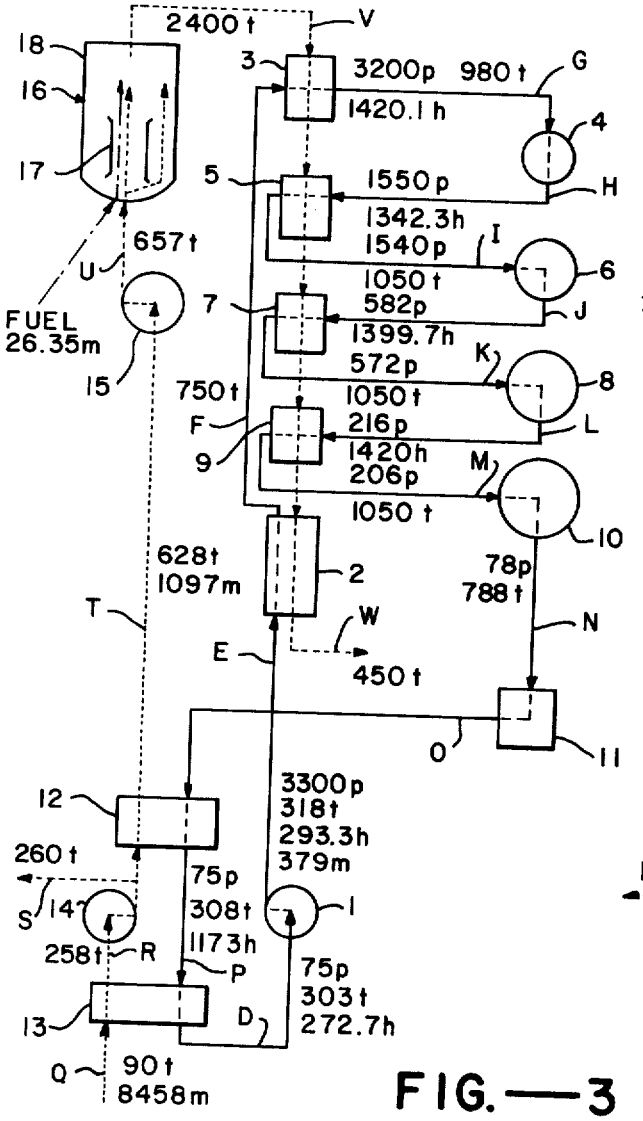
FIG. — 3
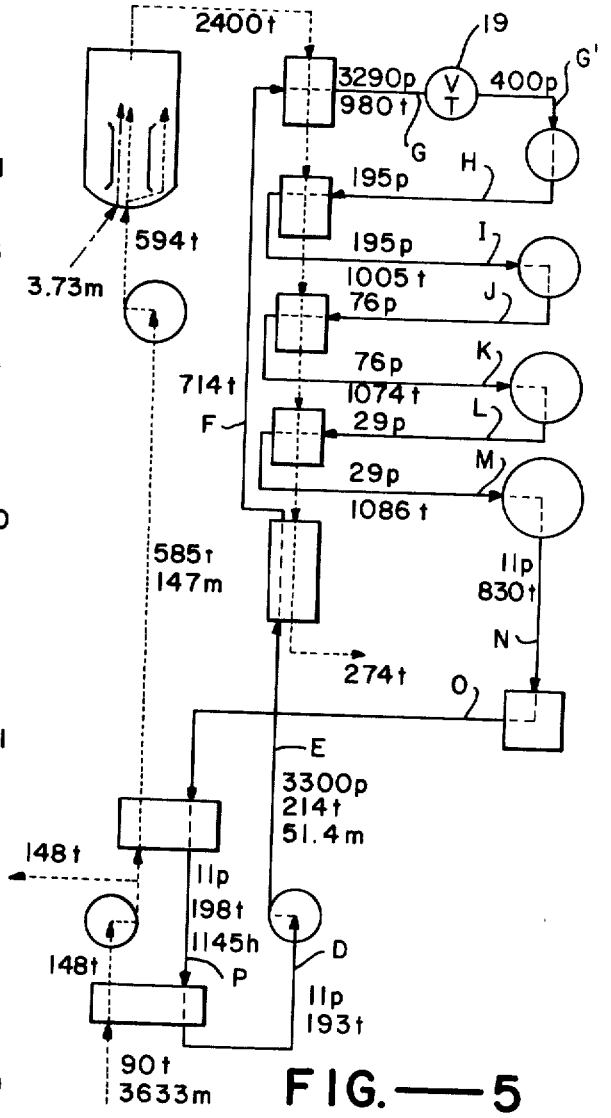
FIG. — 5

EXTERNAL COMBUSTION POWER CYCLE AND ENGINE WITH COMBUSTION AIR PREHEATING

BACKGROUND OF THE INVENTION

The present invention is a new thermodynamic cycle and engine for motive power, such as for automobiles, and is designed to help relieve pressing problems of fuel availability and environmental pollution.

It has become evident that future stability of fuel supplies will require a diversity of energy sources. It is also evident that, if an automobile engine is developed which can cleanly and efficiently burn a diversity of renewable fuels, then the development of such fuels will be encouraged. Finally, it is evident that, to re-establish an equilibrium biosphere, man-made pollutants must be reduced to below natural background levels.

Because transportation consumes about 25 percent of our nonrenewable fuel resources and, in some areas, generates most of the air pollution, it is evident that the internal combustion engine, both gasoline and diesel, must eventually be replaced. The main replacement candidates are the Rankine and Stirling external combustion engines, and the regenerative gas turbine. The gas turbine requires exotic materials and has rather low efficiency. The Stirling engine, although efficient at full power, also requires exotic materials, is very expensive and heavy, and has poor transient response. The Rankine cycle holds the greatest promise primarily because it has great thermodynamic flexibility and need not require exotic materials.

Recently-developed automotive Rankine engines have been large, heavy, and inefficient mainly because the thermodynamic cycles used resembled simplified versions of electric-generating plant cycles or were adopted from early vehicular steam engines. The thermodynamic cycle and engine presented in this disclosure is specifically tailored to vehicular applications, although it is also suitable to marine use and to small-scale electric-generation units.

THE PRIOR ART

The appeal of external combustion engines for vehicular use has generated an extensive technical literature on the subject, but few dramatic successes. No evidence has been found that the thermodynamic cycle disclosed herein has ever been tried. The patented prior art is exemplified by the following patents: U.S. Pat. Nos. 1,783,204 issued Dec. 2, 1930 to Wettstein; 1,961,785 issued June 5, 1934 to Roe; 2,132,212 issued Oct. 4, 1936 to Johannsson; 2,939,286 issued June 7, 1960 to Pavlecka; 3,516,249 issued June 23, 1970 to Paxton; and 3,716,990 issued Feb. 20, 1973 to Davoud.

OBJECTIVES AND SUMMARY OF THE INVENTION

The primary objective of the present invention is to provide a more efficient and less technically-demanding Rankine-type cycle.

Another objective of the invention is to provide a more efficient, more compact, and less expensive external combustion engine for motive power.

Specific objectives of the present invention are to provide or allow: (1) high net efficiencies at low loads, (2) high average heat addition temperatures with moderate peak temperatures, (3) moderate combustion temperatures, (4) high air-fuel ratios, (5) low exhaust gas temperatures, (6) preheated combustion inlet air, (7) high condensing temperatures and pressures, (8) design simplicity, (9) the use of abundant materials and familiar fabrication techniques, (10) multi-fuel operation, (11) rapid starting and restarting, (12) rapid response, (13) low noise operation, and (14) no need for toxic or dangerous materials.

The thermodynamic cycle and engine of the present invention is briefly summarized as follows: Pressurized working fluid is first heated to vapor and then expanded in a series of work-producing stages with low expansion ratios per stage. The fluid is reheated between one or more of the expansion stages with short reheats having high average heat addition temperatures. The working fluid remains superheated after the expansion process and is desuperheated by transferring all of its superheat energy to the combustion inlet air. The working fluid is then condensed by transferring its latent energy to the ambient air, a portion of which is extracted for use as combustion air.

BRIEF DESCRIPTION OF THE DRAWINGS

The satisfactory achievement of the above objectives by the present invention will become apparent from the following description when read in conjunction with the accompanying drawings wherein:

FIG. 1 is a schematic of the working fluid and air state points as plotted on a temperature-entropy diagram for the working fluid, here shown as water, and the air.

FIG. 2 is similar to FIG. 1 except that the state points shown for the working fluid are for part-load, and the air state points have been omitted.

FIG. 3 is a schematic of the engine and gives the heat balance for full power operation.

FIG. 5 is a schematic of the engine similar to FIG. 3 and gives the heat balance for operation at 13 percent power.

DETAILED DESCRIPTION OF THE PREFERRED EMBODIMENT

Figure 4:
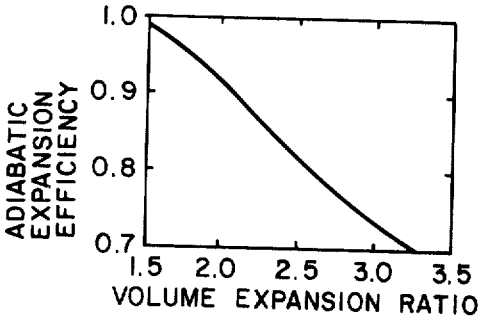
FIG. 4 is a diagram showing expander adiabatic efficiency along the Y axis plotted against expander volume expansion ratio along the X axis.

This description is divided into two parts: In the first part, the thermodynamic cycle for both full and part load operation is described in detail. This description is mainly qualitative in order to acquaint the reader with the basic concept with a minimum of distracting numbers. In the second part, an example reference design of an automobile engine using the present thermodynamic cycle is presented in considerable detail. The extensive detail is presented to demonstrate that all potential problem areas have been considered. In any complex engineering system, overlooking a small detail can destroy the feasibility of the entire concept. The second part of the description is also highly quantified with specific magnitudes of important parameters presented whenever it is appropriate. This is done because the success of any engineering system also depends on the numerical values of the critical variables in the system.

The Thermodynamic Cycle

A representative thermodynamic cycle for the present invention is shown in the temperature-entropy plane in FIG. 1. In the figure, the path the working fluid would take through an engine built according to this cycle is generally designated by the letter A; the path the condenser and combustion air would take is generally designated by the letter B; and the working fluid saturation dome is generally designated by the letter C. The left side of the saturation dome represents saturated liquid and the region to the left of this saturation line is compressed or subcooled liquid. The region inside the dome represents two-phase fluid where pressure and temperature are not independent. The right side of the saturation dome represents saturated vapor while the region to the right of this line represents superheated vapor. The working fluid critical point is at the very top of the saturation dome.

The saturation dome shown in FIG. 1 represents that for water. Although other working fluids could possibly be used in the present invention, water is the most suitable because of its attractive thermal transport properties, thermal stability, and availability.

The solid lines A and B in FIG. 1 represent the steam and air paths and the arrows indicate the direction of fluid flow. The dotted lines represent heat transfer processes between the steam and the air and the arrows there represent the direction of heat flow.

State points of the steam and the air are designated by the letters D through W. The letters indicate specific values of entropies and temperatures at specific points along the flow paths. The identical letter designations are used in FIGS. 2, 3, and 5 for corresponding state points in those figures.

On the steam side in FIG. 1, the process begins with saturated or slightly subcooled water at state D. The water is then compressed, preferably to supercritical pressure, to state E. It is then heated by the combustion air to vapor at state F and then further heated by the same combustion air to superheated vapor at state G. The overall heating path E - G has been divided into heating paths E - F and F - G for proper heat exchanger placement, as discussed below. Work is efficiently extracted from the steam in 4 short expansion stages (with expansion ratios between about 1.5 and 4 to 1 per stage) shown by paths G - H, I - J, K - L, and M - N in FIG. 1. Although any number of expansion stages can be used, four represents an optimum compromise between efficiency and complexity for automobile applications.

Between each of the expansion stages, the steam is reheated in short reheats which have high average heat addition temperatures which, in turn, substantially raise the efficiency of the cycle. Fewer reheats could be used in the cycle, but at a considerable loss in efficiency. The three reheats are shown in FIG. 1 by paths H - I, J - K, and L - M. Because steam pressures are lower in the reheats than in the primary heater discussed above, peak temperatures can be higher and still allow the use of inexpensive materials. For use with positive-displacement expanders, the reheats and their associated ducting are designed to also act as receivers for the interstage steam to avoid recompression of the steam. This step is not required when turbine expanders are employed.

The steam leaves the last expansion stage at state N where it is still highly superheated (typically at about 800° F). With a positive-displacement expander, the steam can then be passed through the expander crankcase where it recovers any blowby and some of the losses due to friction and heat transfer and is thereby heated slightly to state O. With a turbine expander, this step is not required and therefore states N and O coincide. Suspended in the steam as it passes through the crankcase and through the entire system is a fine dust of solid lubricant. The mere passage of the steam therefore provides lubrication for the cranckcase and also for the cylinders, valves, and feedpump. This lubrication concept is discussed in more detail below.

Although the present cycle can be used with a turbine expander, positive-displacement expanders are preferable for applications under about 1000 horsepower. Therefore, the remainder of this disclosure deals exclusively with positive-displacement expanders. Of the many types of positive-displacement expanders which could be employed in the present invention, the conventional reciprocating expander is chosen for discussion in this disclosure because no other types, such as rotary expanders, have been shown to offer any superior overall advantage.

Upon leaving the crankcase, the superheated steam enters a steam-to-air heat exchanger called an economizer where it is desuperheated, and preferably slightly condensed to avoid the possibility of superheated steam in the condenser, by transferring its energy to the inlet combustion air. As shown in FIG. 1, the steam enters the economizer at state O and leaves at state P. It then enters a condenser where it is condensed back to state D and the cycle repeats.

Ambient air enters the condenser at state Q and is heated by the condensing steam to state R. It is then heated slightly to state S by a blower which draws the air through the condenser. The bulk of this condenser air is discarded as rejected heat; however, a portion is extracted for use as combustion air. This portion is directed through the economizer where it is heated by the desuperheating steam to state T. Upon leaving the economizer, the air is heated slightly further to state U by a blower which drives the air through the economizer, steam generator, and exhaust pipe. This blower is placed between the two heat exchangers to minimize noise. It is also placed downstream of the economizer so that the air temperature rise through the blower further heats the combustion inlet air.

The air then enters a burner where it is mixed with fuel and the resulting combustion raises the gas to a moderately-high temperature shown in FIG. 1 as state V. The gases then pass through the primary steam heaters and reheaters and is finally exhausted at state W. Note that, with this configuration, the exhaust gas temperature is the minimum possible an no other heat exchanger is required to regenerate the exhaust gas.

The process of regeneration used in the present invention of preheating the inlet combustion air by desuperheating the exhaust steam is far more attractive than the alternate, and commonly used, means of regeneration, that of preheating the feedwater. Because of the favorable combination of mass flows, specific heats, and temperatures when water is used as the working fluid, the economizer in the present invention is 100 percent effective in fully desuperheating the steam while automatically maintaining large temperature differentials between the steam and the air to drive the heat flows. If the alternate approach were used, that of preheating the feedwater, another heat exchanger would have been required to recover the heat from the very hot exhaust gas. Note only would this heat exchanger be an air-to-air type, the worst combination, but its effectiveness would be well under 100 percent and the steam entering the condenser would still be slightly superheated.

The preheating of the the inlet combustion air reduces the fuel requirement and therefore raises the net efficiency of the system. Note that the temperature rise due to combustion (path U - V in FIG. 1) is less than the temperature drop of the gas through the steam generator (path V - W). More energy is extracted from the gas by the steam than is delivered to it by the fuel and, therefore, the apparent burner efficiency exceeds 100 percent. This does not violate the First Law of thermodynamics; it is merely a result of the regeneration. Also, the entropy drop in the steam during regeneration partly cancels its entropy rise during heating. Thus, with the short multiple reheats, the cycle roughly resembles a Carnot cycle. As a result, net system efficiencies, even including parasitic losses such as friction and blower power, can exceed 50 percent of the theoretical Carnot cycle efficiency.

The cycle for part-load is shown in FIG. 2. Power control is by a simple throttle valve near the inlet to the first expansion stage. This control means is preferable to the more complex means of variable cutoff in which the expansion ratio of the first stage is varied. The apparent advantages of variable cutoff are cancelled by the disadvantages of high expansion ratios: lower adiabatic expansion efficiencies, lower mechanical efficiencies, greater blowby, greater bearing loads, and unequal power strokes. The losses due to throttling are in fact largely recovered by the expansion to lower condensing pressures and the resulting lower condensing and heat rejection temperatures. By placing the throttle at the expander inlet rather than the feedpump discharge, the stored energy in the steam generator permits rapid response, and thermal cycling in the steam generator is minimized. Note also that, because of the lower steam pressures at part load, the expander, economizer, and condenser are substantially understressed much of the time.

The path of the steam through the throttle is shown in FIG. 2 by the path G - G', which is an isenthalpic path crossing the steam isobars to lower pressure. Because of the still lower pressures in the reheats, reheat peak temperatures can be higher at part load than at full load.

Because of the high condensing temperatures even at part load, the condenser blower can be a simple fan. In fact, under most conditions, ram air due to the forward motion of the vehicle will be sufficient to cool the condenser.

In the remainder of this description, the reduction to practise is demonstrated by discussing a typical reference engine design for a 100 brake horsepower (bhp) engine in a 3000 pound vehicle. Detailed heat balances are shown for full and cruise power. Also presented are performance specifications, component layout, component physical specifications, lubrication, descriptions of the hardware, control system, starting and shutdown sequence, thaw system and insulation, corrosion prevention, maintenance, sealing, and the air-ejection system. All of these details are presented because, as mentioned above, overlooking any one of them could invalidate the feasibility of the entire concept.

EXAMPLE REFERENCE DESIGN

Heat Balances

A heat balance is an energy accounting ledger in which energy flows through the system are established. For simplicity, second-order flows, such as those through the fuel pump, control system, and generator are neglected. It is customary to present heat balances in the form of system block diagrams, as is done in FIGS. 3 and 5 for full and 13 percent power, respectively.

In the heat balances in FIGS. 3 and 5, the solid lines represent steam paths through conduits or ducts between major components; the dashed lines represent steam paths through the major components, and the dotted lines represent the air and combustion gas paths through and between the major components. Major components are identified by numerals and steam state points are identified by the same letters as used in FIGS. 1 and 2. The heat balance in FIG. 3 corresponds to the cycle in FIG. 1; while that in FIG. 5 corresponds to the cycle in FIG. 2.

In order to facilitate the reading of this description, the steam properties at each state point in FIGS. 3 and 5 are listed on the figures in abbreviated form as numerals followed by a letter which indicates the property. In the figures, $p$ is the steam pressure in pounds per square inch absolute (psia), $t$ is the temperature in degrees fahrenheit, $h$ is the enthalpy in BTu/lb, and $m$ is the mass flow in pounds per hour.

In FIG. 3, the full power heat balance, the process begins with liquid water at state D(75 psia and 303° F, which is 5° subcooled to avoid any cavitation in the feedpump) entering feedpump 1 where it is compressed to a pressure slightly above the critical pressure of water and emerges therefrom at a state E. The compressed liquid then enters the steam generator, which is divided into water heater 2, superheater 3, and reheats 5,7, and 9. With respect to the flow of combustion gas through the steam generator, water heater 2 is placed downstream of the other steam generator heat exchangers so as to minimize the exhaust temperature of the combustion gas and, in so doing, minimize the heat rejected by this exhaust gas.

Water heater 2 actually heats the water to vapor at 750° F (state F). This vapor then enters superheater 3 where it is further heated to 980° F and emerges therefrom at a pressure of about 3200 psia (state G).

The vapor then alternately passes through each of the four expansion stages 4, 6, 8, and 10 and each of the three reheats 5, 7, and 9. In the first stage, the steam is expanded over a volume expansion ratio of 1.8 to 1 and emerges therefrom at a pressure of 1550 psia (state H). In the remaining three expansion stages, the steam is expanded over volume expansion ratios of 2.2 to 1 each. In each of the three reheats, the steam is reheated each time to a temperature of 1050° F. The steam exhausting from expansion stages 4, 6, and 8 are at states H, J, and L, respectively; while the steam leaving reheats 5, 7, and 9 are at states I, K, and M, respectively.

The adiabatic expansion efficiency for the first expansion stage 4 is taken to be 90 percent; while, for the remaining expansion stages 6, 8, and 10, it is taken to be 87 percent. These values are taken from a summary of experimental data shown in FIG. 4 for compound steam engines using dry steam. The high expansion efficiencies shown in FIG. 4 for low expansion ratios point out the significant advantage of using such low expansion ratios in each expansion stage and deriving high overall steam expansions by using a number of such stages in series. A further advantage is a more favorable distribution of friction power, as is discussed later.

Upon leaving the last expansion stage 10, the steam is at a pressure of 78 psia and a temperature of 788° F (state N). It then passes through expander crankcase 11 where it provides lubrication by means of a suspended dust of lubricant (discussed below) and picks up any blowby and heat from friction and heat transfer. These heat recoveries are conservatively ignored in this heat balance. Therefore, states N and O coincide in this case.

The steam then passes to economizer 12 where it is desuperheated and slightly condensed to state P by transferring its superheat energy to the incoming burner air. The steam emerges from economizer 12 at 75 psia and 308° F (state P) and passes to condenser 13 where it is fully condensed and slightly subcooled to state D, and the steam cycle repeats.

Note that the use of economizer 12 for regeneration is feasible only if the steam pressure after leaving the expander is high and, therefore, the steam volume flow is low. This high steam pressure also results in a high condensing temperature (308° F), which yields a very compact condenser for this air-cooled engine.

Ambient air, here taken to be at 90° F (state Q), enters the air side of condenser 13 where, by extracting heat from the condensing steam, is heated to 258° F (state R). The air is drawn through the condenser by blower 14. Because of the high steam condensing temperature, blower 14 consumes at most 1.04 horsepower assuming its compression efficiency is 50 percent. Because ram air will frequently drive enough air through the condenser, blower 14 need only operate in hot weather. Although the ambient air is taken here to be 90° F, the engine can still deliver 75 percent of full power even in 120° air. At even higher temperatures, the engine continues to run smoothly, but less efficiently due to the rise in condensing temperature and pressure.

The air leaves blower 14 at 260° F (state S) and is mainly discarded. A portion, however, is retained for use as combustion air. This portion passes through economizer 12 where it is heated by the desuperheating steam to 628° F (state T). It then passes through blower 15 where it is further heated by compression to 657° F (state U). The air then passes into burner 16 which is subdivided into primary burner 17 and secondary burner 18. In primary burner 17, fuel is injected with a small portion of the air forming a very rich fuel-air mixture. If the ignition point of the fuel is below the air temperature, a small fraction of the fuel ignites and the energy thus released goes into vaporizing or further heating the remaining fuel and air. If the ignition temperature of the fuel is above the air temperature, the fuel merely mixes thoroughly with the primary air in burner 17 without igniting. The mixture from primary burner 17 then passes to secondary burner 18 where it mixes with the remaining air from blower 15, which had bypassed the primary burner, and is thoroughly burned with nearly 200 percent excess air such that the temperature of the resulting gas is 2400° F (state V).

This combustion temperature of 2400° F is high enough to produce ample system efficiency and to fully oxidize any CO, C, and $H_2$ that formed in primary burner 17. Yet it is low enough to produce negligible $NO_x$ and eliminates the need for burner-wall cooling air or water-tube quenching of the combustion gas at the steam generator inlet.

The combustion gas then passes through the steam generator consisting of superheater 3, reheaters 5, 7, and 9, and water heater 2 where it is cooled to 450° F (state W) and exhausted.

As is discussed below, the peak expander speed is taken to be 4000 revolutions per minute (rpm). In the discussion that follows, the expander speed is 2000 rpm, which is taken to be the most commonly used speed in normal driving. At cruise, it is taken to indicate 40 miles per hour (mph) vehicle speed.

At full power 2000 rpm, the indicated powers (defined here as the power extracted from the steam) for each expander stage are 11.6, 17.7, 18.5, and 18.7 indicated horsepower (ihp) for expansion stages 4, 6, 8, and 10, respectively. These result from a steam flow rate of 379 pounds per hour. With a compression efficiency of 0.5 and a mechanical efficiency of 0.9 feedpump 1 consumes 3.4 hp. With a required air flow through condenser 13 of 8458 lb./hr, blower 14, as mentioned above, consumes 1.04 hp. With a combustion air flow of 1097 lb./hr, blower 15, assuming a compression efficiency of 0.5, consumes 2.97 hp. A kinematic analysis of the expander design has shown that, conservatively taking the lubricant sliding coefficient of friction to be 0.2, at 2000 rpm about $\frac{3}{8}$ of the expander friction goes linear with steam pressure while $\frac{5}{8}$ is proportional to the engine speed squared. The full power expander mechanical efficiency at 2000 rpm has been calculated by this analysis to be 94 percent. At 1000 rpm, it is 95.3 percent; while, at 4000 rpm, it is 87.1 percent. The horsepower delivered to the expander shaft is therefore 62.5 hp at full power 2000 rpm. Subtracting the above parasitic losses, the net brake horsepower of the engine is 55.1 bhp. Taking gasoline to be the fuel (20,000 BTu/lb lower heating value) the required fuel rate is 26.35 lb./hr. The net system efficiency of the engine at full power 2000 rpm is therefore 26.6 percent and the specific fuel consumption is 0.48 lb/bhp-hr. The air-fuel ratio is 38.2, which is 2.7 times that needed to fully burn the gasoline.

As is shown below, the part-load efficiency is almost as good as at full power, which is due to unique features of the cycle, such as the low expansion ratios which give a favorable distribution of expander friction power.

The heat balance for the 13 percent load point is shown in FIG. 5. Steam pressure and flow are controlled by the gate-type throttle valve 19 at the first expansion stage inlet. The steam is throttled by the valve from state G at a pressure of 3290 psia to state G' at a pressure of 400 psia. Because of the throttle, all pressures in the expander, economizer, and condenser are about one-eighth the peak pressures at this load setting. The only components which always operate at peak steam pressure are the feedpump, feedline, water heater and superheater, and the primary steam line to the throttle. Because of the lower steam pressures, reheat temperatures can be even higher at part load, as they are in the last two reheats, which further increases part-load efficiency.

Because of the low expansion ratios per stage in the expander, mean effective pressures are over 70 percent of the peak pressures. Therefore, reciprocating masses are quite low. This produces a favorable distribution of friction power, the bulk of which, as discussed above, is proportional to steam pressure. Therefore, expander mechanical efficiencies are much higher at low loads than high-expansion steam engines and internal combustion engines. With a lubricant sliding friction coefficient of 0.2, the expander in the present invention is calculated to have a mechanical efficiency of 86 percent at 13 percent power.

With a required steam flow rate of 51.4 lb./hr, the expander indicated powers are 1.62, 2.41, 2.61, and 2.63 ihp for the first, second, third, and fourth stage, respectively. The feedpump compression and mechanical efficiencies at this load are taken to be 35 and 80 percent, respectively, somewhat less than at full power, and therefore its power drain is 0.73 hp. With required air flows of 3633 and 147 lb./hr through the condenser and burner, respectively, the two air blowers consume 0.08 hp total. The required fuel rate is 3.73 lb./hr of gasoline. The expander shaft output is 7.97 hp and, subtracting the above losses, the net engine output is 7.16 bhp.

The net engine efficiency at 13 percent power 2000 rpm is therefore 23.9 percent and the corresponding gasoline specific fuel consumption is 0.53 lb./bhp-hr. Such a high efficiency at such a low load setting is nearly double that of many internal combustion engines. The relative insensitivity of engine efficiency with load setting produces fuel consumptions in miles-per-gallon that are very sensitive to speed, as discussed later.

Note that the exhaust gas temperature (state W) of 274° F is still high enough at this low load setting to avoid condensation and consequent corrosion problems. Also, the condensing temperature (state P) of 198° F is also high enough to provide adequate condensing even in 120° ambient air.

The power output per stage differs by about 60 percent at this load (1.62 ihp vs. 2.63 ihp). At such a low load, this difference should not affect engine smoothness especially because, in the expander chosen (discussed below), two power strokes are occurring at any time.

Engine Physical Layout

Figure 6:
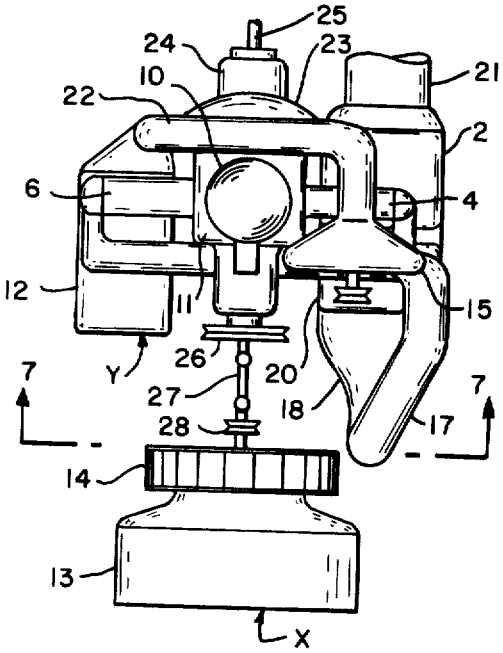
FIG. 6 is a top plan view of an example engine layout constructed in accordance with the present invention.
Figure 7:
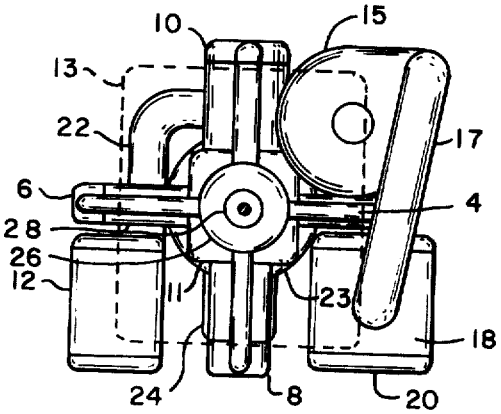
FIG. 7 is a front elevational view of the engine taken along the line 7—7 of FIG. 6 with the condenser and condenser blower omitted for clarity but with the outline of the former shown by a broken line.
Figure 8:
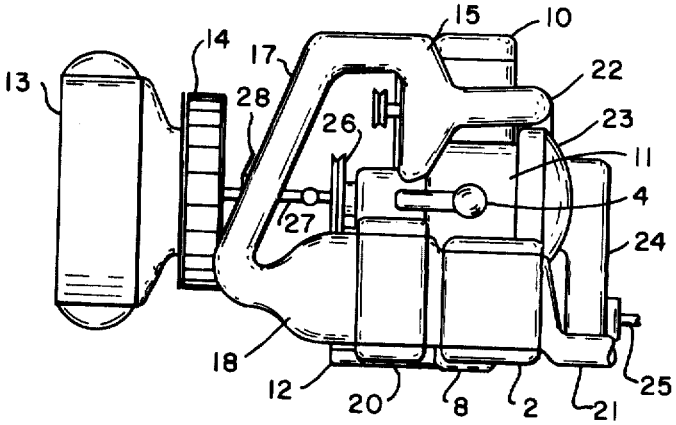
FIG. 8 is a side elevational view of the engine of FIG. 6.

The preferred engine layout is shown in FIGS. 6, 7, and 8. The components are placed so as to achieve the lowest center of gravity and the maximum maintenance access. The engine is sized for 100 brake horsepower at 4000 rpm and employs a two-speed transmission. Although steam expanders have such favorable torque-speed characteristics that they can be used in direct-drive mode, for the same acceleration requirements the engine can be made smaller and less expensive by using a two-speed transmission. A conventional torque convertor couples the expander to the transmission.

The numerical designations for the components shown in FIGS. 6, 7 and 8 are identical to those used for the corresponding schematic components shown in FIGS. 3 and 5. Because the steam and air flow paths were discussed in detail for the latter two figures, they are discussed only briefly here for FIGS. 6, 7, and 8.

On the steam side of the system, condensate from condenser 13 is drawn into a feedpump (not shown) and then passed to water heater heater 2 and then to the superheater, which is in heat exchanger 20 and is located nearest secondary burner 18 so as to receive the highest combustion gas temperature. The steam then passes alternately between expansion stages 4, 6, 8, and 10 and reheats 5, 7, and 9 (FIG. 3) which are located behind the superheater in heat exchanger 20. The steam then passes through expander crankcase 11 and then to economizer 12 where it is fully desuperheated and slightly condensed (to state P in FIG. 1). It is then fully condensed in condenser 13 and the steam circuit repeats.

On the air side, ambient air enters the front of condenser 13 (front indicated by the letter X in FIG. 6). After being drawn through the condenser by blower 14, the air is discharged into the engine compartment (not shown) and mainly exhausted beneath the vehicle. A portion of this air, however, enters the front of economizer 12 (front indicated here by the letter Y). This air serves as combustion air and is preheated in economizer 12 by the desuperheating steam from expander crankcase 11. The air then passes by way of duct 22 to blower 15 which draws the air through the economizer and drives it through the steam generator. After passing through blower 15, the air enters primary burner 17, which consists of two concentric tubes with the air flowing through each. Fuel is mixed with the air flowing through the smaller tube and, as discussed above, either complete mixing and partial ignition occurs in this tube, or mixing alone, depending on the fuel ignition temperature. This primary air-fuel mixture then passes to secondary burner 18 where it is mixed with the air that passed around primary burner 17 and the fuel is completely burned. The resulting combustion gases then pass through heat exchanger 20 which consists, in order, of superheater 3, and reheaters 7, 9, and 5 (see FIG. 3). The gases then pass through water heater 2 and are then exhausted via exhaust pipe 21.

Power from the expander is delivered to torque convertor 23 which transmits it to transmission 24 andd thence to driveshaft 25 which is connected to the drivewheels (not shown).

The battery, starter/generator, fuelpump, control electronics package, feedpump, air ejector pump, and steam plumbing have been omitted for clarity in FIGS. 6, 7, and 8. They are, however, discussed later in this description. The starter/generator, feedpump, and blower 15 are driven by the expander by means of pulley 26. Condenser blower 13 is driven by the expander by means of shaft 27. The air ejector pump is driven by the expander by means of pulley 28. The fuel pump is electrically driven.

It is worthwhile to compare this engine, which uses a rather complex thermodynamic cycle, with a conventional steam engine which uses a simple cycle with no reheats or regeneration. For similar smoothness and balance, the latter engine also requires a four-cylinder expander but this time with the steam flowing in parallel through each cylinder. In the engine of the present invention, one requires a four-cylinder expander, three steam-to-air heat exchangers (the steam generator components count as one), 11 pieces of working fluid ducting, a feedpump, and two blowers. In the conventional engine, one requires a four-cylinder expander, two steam-to-air heat exchangers, 10 pieces of working fluid ducting, and two or three blowers. As discussed below, the engine of the present invention weighs 4–5 lb./hp and has gasoline specific fuel consumptions around 0.5 lb/hp-hr. Conventional steam engines have typically weighed 8–10 lb./hp and have had specific fuel consumptions over 0.8 lb/hp-hr at full power and worse at part load. The added hardware complexity in the present invention amounts to (a) different-sized cylinders rather than the same size, (b) a third, rather small, heat exchanger, and (c) one more piece of working fluid ducting. This minor increase in complexity is more than offset by the lighter weight and greater efficiency.

Each of the components of the example reference design are now described in detail. Other subsystems and operating procedures are also discussed.

Engine Components and Subsystems

Expander

The expander containing expansion stages 4, 6, 8, and 10, and crankcase 11 (FIG. 7) consists of two well-known Scotch Yoke assemblies mounted on the same crank arm. The first two stages comprise the horizontal yoke and the last two make up the vertical yoke (FIG. 7). Three roller bearings are used: one between the single crank arm and the two piston yokes, and one supporting each end of the crankshaft.

For the reader who is not familiar with the basic Scotch-Yoke, a simple two-cylinder version consists of the following: two pistons and cylinders 180° opposed with the pistons rigidly connected to each other. The crank arm fits through a slot in the piston assembly which is located about midway between the pistons. The slot width along the piston axis equals the diameter of the crank arm bearing plus a small clearance. The slot height normal to the piston axis equals the crank arm stroke plus the diameter of the crank arm bearing plus a small clearance.

In the expander in the present invention, two of the above piston assemblies are used and they are placed normal to each other. The two piston assemblies have identical masses and the counterweight mass on the crankshaft equals the mass of either piston assembly. Therefore, the expander is inherently balanced.

A Scotch-Yoke expander is chosen because of its simplicity, inherent balance, and favorable moment-arm ratios which reduce piston side thrust, the major source of friction. Any difficulties arising from the point contacts and clearances between the crank arm bearing and the slot surfaces are mitigated by the use of a thick crank arm bearing outer race, by the fact that two power strokes 90° apart are occurring at any time, and by the low expansion ratios which minimize the peak bearing loads.

The expander crank stroke is 2.75-in. for all four stages. The cylinder bores for the four stages are, in order, 1.045, 1.820, 3.030 and 5.070-in. The cylinder wall thicknesses are, also in order, 0.40, 0.34, 0.23, and 0.16-in., which allow 0.06-in. wear over the life of the engine. Note that only the very small first stage need withstand the very high pressure inlet steam and then only at full power. The progressively larger downstream stages need only withstand progressively lower steam pressures. It is for this reason that equal reciprocating masses are possible for each piston pair with the resulting inherent balance. The first stage piston is sealed against steam blowby with 6 expandable piston rings. The remaining stages are sealed with, in order, 5, 3, and 2 expandable piston rings. The expander cylinders, heads, and valves are made of low-alloy chrome-moly steel. The remainder of the expander is made of mild steel.

The expander is counterflow with poppet valves, which have known long-term reliability, used for both intake and exhaust. Both valves are located in the cylinder head. The intake valve opens outward, away from the piston, while the exhaust valve opens inward, as in conventional engines. In this way, steam pressure tends to keep both valves sealed. The losses due to steam counterflow are minor with the superheated steam because of the very low expansion ratios and resulting low temperature differentials. Three cam lobes, two intake and one exhaust, serve all the valves. They are mounted on the crank axis. The valve springs are mounted in the cooler region near the cams and roller lifters so that the pushrods are loaded in tension only.

The expander is calculated to have a weight of about 130 lb. The torque convertor and transmission weight is estimated at about 50 lb.

Lubrication

Figure 9:
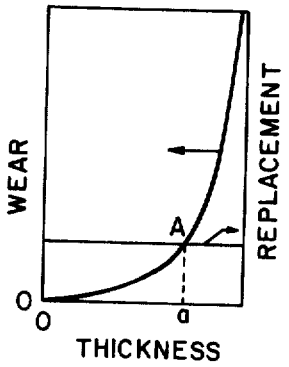
FIG. 9 is a diagram which indicates lubricant wear and replacement rates as a function of lubricant film thickness.

The expander and feedpump are lubricated by a small quantity of finely-powdered dry lubricant which is mixed with the working fluid and circulates with it throughout the system. Considerable work on dry lubrication has already been accomplished in the space program. The wear surfaces also have a thin coating of the dry lubricant. The wear rate of this coating is a strong direct function of the film thickness. As the film wears during operation, it is continuously replaced by the lubricant suspended in the working fluid. This is shown qualitatively in FIG. 9. Because the replacement rate is essentially independent of the film thickness, there is always a nonzero film thickness at which the replacement rate equals the wear rate, and therefore an equilibrium lubricant film thickness is established. This is shown in FIG. 9 by the intersection of the two curves at A which corresponds to the equilibrium film thickness *a*. To ensure suspension of the lubricant in the steam at low loads, the finest possible particle size is used and care is taken in the design to avoid stagnation points.

Two dry lubricants appear most promising: lead monoxide (litharge), and calcium difluoride ($CaF_2$). Both lubricate by shear flow due to localized heating, and both have coefficients of friction under 0.15 between 600° and 1300° F and under 0.3 between 150° and 600° F. Both are chemically stable in oxidizing atmospheres up to at least 1300° F, which is well above the maximum inside tube wall temperature in the steam generator. Both have low specific heats, and therefore fairly large quantities can be added to the steam without affecting the thermodynamics.

Because the steam generator uses small tubes with relatively thin walls, considerable plating of the lubricant onto the inside tube walls is acceptable. However, because there is no mechanism to drive the lubricant dust into the surface voids, as there is with the piston rings and roller bearings in the expander and feedpump, little plating is expected. The same is true with the economizer and condenser, where potential problems from plating are even less.

Steam Generator

The steam generator, economizer, and condenser heat exchanger experimental data is taken from the text: Kayes and London, *Compact Heat Exchangers*, Second Edition, McGraw-Hill, 1964. In some cases, minor changes have been made to the geometry and these are explained when appropriate.

All steam generator tubes are $\frac{3}{8}$ scale versions of Kayes and London surface CF-8.72 and have welded steel fins. The specifications are: Fin outside diameter = 0.613-in., tube outside diameter = 0.25-in., tube inside diameter = 0.15-in., fin thickness = 0.012-in., fin spacing = 13.08 per inch, tube spacing = 0.536-in. center-to-center parallel to the air flow and 0.653-in. normal to the air flow. The tubes are staggered parallel to the air flow.

Going from the burner to the exhaust pipe, the steam generator components are arranged in the following order: superheater, second reheat, third reheat, first reheat, and water heater. This arrangement yields the most compact steam generator and the minimum exhaust temperature.

The first four steam generator components each consist of a single bank of 12–7-in. long low alloy chrome-moly steel tube and fin assemblies. For minor adjustments in heat flows, flats are ground on the fins where needed. One-inch diameter manifold tubes are welded to the finned tubes at each end. For the superheater and first reheat there are three tubes per steam pass and the manifold inside diameter is 0.60-in. For the second and third reheats there are six tubes per steam pass and the manifold inside diameter is 0.80-in. The water heater, which comprises the bulk of the steam generator, consists of 12 rows of 12–5.92-in. long mild steel tubes with three tubes per steam pass. The same manifold, except here it is mild steel, is used as in the superheater. The water heater exit temperature is 750° F at full power so that some steam is actually formed in the last two banks of tubes.

At full power 2000 rpm, the steam generator heat flux is 599,000 BTu/hr. The calculated overall heat transfer coefficients and inlet combustion air temperature at 2000 rpm full power for the superheater, second, third, and first reheat, and water heater are, respectively, (in BTu/hr-ft$^2$-° F and ° F): 19.2 and 2400, 14.1 and 2115, 13.5 and 1943, 17.9 and 1777, and 20.7 and 1560. Also in the same order, the steam-side pressure drops (in psi) and air-side blower power (in BTu/lb steam with 50 percent blower efficiency) are, respectively, 1.6 and 1.5, 2.4 and 1.2, 7.8 and 1.2, 9.3 and 1.2, and 10.3 and 7.1. Note that the steam-side pressure drops are less than those assumed in the heat balance in FIG. 3 and therefore system efficiencies should be slightly higher. At 13 percent power, the steam side pressure drops are 0.017 times those above, or virtually negligible. Also, in the same order as above, the steam generator fin effectivenesses are: 0.67, 0.66, 0.72, 0.74, and 0.72. Although copper fins would raise these values, brazed copper joints would tend to be less reliable than welded steel joints.

The steam generator weight, including manifolds, is calculated to be 36 pounds. Of that 11 lb. is chrome-moly steel (e.g. 2 percent chrome, 0.5 percent molybdenum) and the rest is mild steel.

Economizer

The economizer is from Kayes and London surface ⅛-16.00(D) with 0.004-in. mild steel surfaces and is made 30 percent oversized to obtain the efficiency gain from partial steam condensation and to ensure that no superheated steam enters the condenser. It consists of strip-fin surfaces with alternating passages of steam and air. The specifications are: 0.255-in. wide finned flow passages, 0.125-in. fin widths in the flow direction (fins are formed from single stampings), 16–0.004-in.thick fins per inch with 0.004-in. fin splitters. The steam-side and air-side heat transfer areas are equal with one pass on the air side and 10 on the steam side. The steam flow frontal dimensions are 6-in. by 1.01-in. with 1-inch high steam manifolds for reversing the steam flow.

At 2000 rpm full power, the economizer heat flux is 126,000 BTu/hr. The air-side heat transfer coefficients and fin effectivenesses are, respectively, 42.3 BTu/hr-ft$^2$-° F and 0.73; the corresponding steam side values are 98 BTu/hr-ft-$^2$-° F and 0.59. The burner blower work, assuming 50 percent blower efficiency, is 8.9 BTu/lb steam and the steam side pressure drop is 3.1 psi.

The economizer core dimensions are 7-in. high by 6-in. wide by 10.2-in. deep. Its weight, including steam and air manifolds, is calculated to be 18 pounds. Fabrication is by conventional furnace braze. Note that, despite the thin steel used, the geometry is such that is can withstand much more than the 63 psi pressure differential required of it.

Condenser

The condenser is adapted from Kayes and London surface 1/6–12.18(D). It is a strip-fin surface with 0.006-in. aluminum fins and steam jacket walls. The specifications are: 0.625-in. between steam jackets, 0.125-in. wide (outside) steam jackets, 12.18 fins per inch on the air side, no fins on the steam side, 0.178-in. fin width in the air flow direction (fins formed by single stampings). It is made 20 percent oversize to allow for bug blockage and dirt fouling.

At 2000 rpm full power, the condenser heat flux is 341,000 BTu/hr. The air-side heat transfer coefficient and fin effectiveness are, respectively, 20.6 BTu/hr-ft$^2$-° F and 0.84. The steam side condensing coefficient is 770 BTu/hr-ft$^2$-° F. Therefore, the overall air-side heat transfer coefficient is 14.1 BTu/hr-ft$^2$-° F. The condenser blower work, assuming 50 percent blower efficiency, is calculated to be 5.7 BTu/lb steam, which is under the value of 7.0 assumed in the heat balance in FIG. 3.

The condenser core is 16-in. wide by 15-in. high by 5.3-in. deep. There are 22 steam jackets. Fabrication is by conventional aluminum furnace brazing. Like the economizer, the condenser geometry is such that it can withstand much more than the 60 psi pressure differential required of it. The total condenser weight, including manifolds, is calculated to be 16 pounds.

Feedpump and Feedpressure Control

The feedpump (not shown in FIGS. 6, 7, and 8) is a two-cylinder single-acting Scotch-Yoke pump operating at one-half the expander speed. The cylinder bore and stroke are 0.486 and 0.500in., respectively, and the capacity at 2000 rpm is 186 in$^3$/minute. Lubricant-bearing condensate enters through the feedpump crankcase and passes through a one-way valve in the piston to the cylinder chamber. It then passes through a one-way valve in the cylinder head to the feedline and steam generator. As with the expander, roller bearings are used throughout.

The peak water pressure is about 3300 psia and is controlled as follows: A mechanism downstream of the feedpump contains a small piston which is held in position by a long-stroke precompressed control spring. The piston is forced backwards against the spring whenever the feedwater or steam pressure exceeds 3300 psig. This piston motion opens a small valve in the feedwater line which causes the feedwater from the feedpump discharge to return at low pressure to the feedpump crankcase. A one-way valve downstream of this bypass valve prevents high-pressure feedwater in the remaining feedline and water heater from backflowing into the feedpump crankcase. The energy absorbed by the control spring is recovered whenever the water or steam pressure drops to below 3300 psig, which cause the piston to return and close the bypass valve.

The cycling rate of this control mechanism depends on the ratio of the first stage expander intake volume to the steam volume upstream. If this ratio is small, as it is here, the cycle time will be many expander revolutions so that the feedpump operates mainly under full load or no load, which are the most efficient modes.

With this type of control mechanism, there is negligible throttling of the feedwater and therefore feedpump efficiencies at part load are nearly as high as at full load. Note that the partload heat balance in FIG. 5 allows for some loss in feedpump efficiency.

The feedpump is designed to have a minimum water inventory. The feedpump weight is calculated to be about 4 pounds.

Air Blowers

The condenser blower is a simple centrifugal fan made of aluminum or mild steel. Because of its low power consumption, it can be directly coupled to the expander and driven at expander speed; and control can be effected by a variable air-flow device such as a window shade or variable louvers ahead of the blower. To deliver the required air flow through the condenser at full power, the condenser blower must be 12.6-in. outside diameter, 8.4-in. inlet diameter, and 2.5-in. deep. At all cruise load settings in the reference design, the condenser blower can be disconnected because ram air from vehicle forward motion is sufficient to drive air through the condenser.

The burner blower is also centrifugal but, because of the higher air temperatures, is made of mild steel. Because of its higher power consumption, it is controlled by a variable-speed drive such as the well-known Variator drive used on small utility vehicles. To deliver the required air flow through the economizer and steam generator, the burner blower has an outside diameter of 8.0-in. and an inlet diameter of 3.0-in. The blower depth at the inlet is 1.0-in. and at the tip it is 0.38-in. At full power 2000 rpm, the burner blower must deliver a pressure rise of 0.565 psi, which is accomplished by turning it at 10700 rpm. Two coupled sets of belts and pulleys drive this blower from the expander. At full power 2000 rpm, they each form a speed ratio of 2.32 to one.

Despite the hot air that the burner blower must pass, it is still best to place this blower upstream of the economizer so that its noise is muffled and so that the air temperature rise through it does not reduce the steam-to-air temperature differential through the economizer.

Both air blowers and housings are estimated to weigh a total of 25 pounds.

Burners

The primary burner consists of two concentric tubes about 13-in. long. The outer tube diameter is 2.5-in. and the inner tube diameter is 0.6-in. Preheated air from the burner blower passes through both tubes with about 6 percent of it passing through the inner tube. Fuel of any sort, including liquid/solid slurries, is dribbled from a small tube into the air in the inner tube. A series of turbulent mixing vanes in the inner tube assures thorough mixing of the fuel and primary air. If the fuel has an ignition temperature below that of the primary air (after being cooled by whatever fuel is vaporized), then partial ignition occurs in the primary tube. However, the mixture is so rich (about 2.5 to one with gasoline) that little temperature rise occurs and most of the energy released goes into vaporizing the remaining fuel. If the fuel ignition point is above the primary air temperature, then the fuel and air are merely thoroughly mixed without igniting.

If ignition does occur, some CO, C and $H_2$ are formed. These products are thoroughly burned in the secondary burner because the combustion temperature there is well above their ignition temperature.

The secondary burner (18 in FIGS. 6 to 8) consists of a flared, rectangular volume of about 0.1 $ft^3$. The flare is contoured to minimize turbulence and therefore assure quiet operation. The primary air with fuel is mixed with secondary air at the entrance to the secondary burner. A glow plug for starting is located just downstream of this mixing point.

The combustion temperature in the secondary burner of 2400° F is more than sufficient to burn any partial products that may have formed in the primary burner. Yet it is low enough to minimize any $NO_x$ formation. The air-fuel ratio with gasoline of 39 to 1 by weight is more than adequate to ensure complete combustion of the fuel. Fuel control is by a negative-feedback mechanism, which is discussed later.

The specific volume of the secondary burner of 6 million BTu/hr-$ft^3$ at full power 2000 rpm may seem high. However, those tasks normally associated with the burner such as air heating and fuel mixing are performed by the economizer and primary burner, respectively, and not by the secondary burner.

Both burners are made of mild steel. If necessary for corrosion protection, their inside surfaces can be coated with a thin film of a suitable ceramic such as $Al_2O_3$ (which has the same thermal expansivity as steel). Strength is provided in the secondary burner wall by a corrugated steel construction much like a shipping carton. The corrugations also provide insulation (insulation is discussed in more detail later).

Both burners are estimated to weigh a total of 20 pounds.

Fuel Pump

The fuel pump is an electrically-driven positive-displacement pump such as the well-known Flex-Vane and is designed to handle a variety of fuels such as liquid/-solid slurries. The delivery rate can vary between 0.1 and 170 $in.^3$/min. The control system regulates both a bypass valve in the fuel line and the voltage applied to the fuel pump motor. The fuel pump assembly is estimated to weigh about 3 pounds.

Control System

There are five controlled parameters: (1) steam flow rate (0.5 - 760 lb/hr), which is controlled by the throttle valve at the first stage expander inlet; (2) the feedpressure (3200 - 3400 psi), which is controlled by a pressure-operated bypass valve as has been discussed above; (3) combustion temperature in the secondary burner (2300° - 2500° F), which is sensed by a thermocouple in the burner and regulated through an electrical feedback circuit that varies the burner air flow by controlling the variable speed drive on the burner blower; (4) superheater exhaust steam (960° - 1000° F), which is sensed by a thermocouple and regulated by a feedback circuit which adjusts the fuel flow rate, as discussed above; (5) condensate temperature (2° - 8° F subcool), which is sensed by a thermocouple with the hot junction in a steam jacket and the cold junction in the hotwell beneath the condenser and regulated by a feedback electrical circuit which adjusts the window shade or louvers that control the condenser air flow.

The control system responds as follows: Upon power demand (throttle valve opened), the drop in steam temperature is sensed and corrected by increasing the fuel flow. The resulting rise in combustion temperature is sensed and corrected by increasing the burner air flow. The drop in the degree of condensate subcooling is sensed and corrected by increasing the condenser air flow. The feedpressure remains constant by means of its own control.

Note that the control system is negative feedback throughout and therefore no metering jets are required. The well-known electronic feedback circuits can be placed on a single printed circuit board or integrated circuit and mounted inside the passenger compartment for protection.

Note also that the reheat temperatures are not controlled. Rather, they set their own level within a narrow temperature range, as discussed earlier.

Because of the tolerances in the controlled temperatures and because of the steam generator thermal mass, the control system can be used to provide cycled combustion and combustion shutdown during idling, coasting, and low-power operation.

Steam and Air Ducting

The steam and air ducting are sized so that the pressure drops through them are always small compared to the pressure drops through the heat exchangers. In addition, the steam ducting between expander stages are made oversize to provide ample receiver volume to minimize interstage recompression losses. Because the expansion ratios are around 2 to 1, these receiver volumes must be large only compared to half the displacement of adjacent upstream stages. The duct wall thicknesses are such that hoop stresses due to steam pressure never exceed about 5000 psi and, in most cases, are much less. This large safety margin allows for the fact that most plumbing failures occur at the connections and not by tube splitting.

On the steam side, typical duct inside diameters, in inches, are as follows: feedpump out — 0.20, water heater out — 0.4, superheater out — 0.6, stage 1 out — 0.6, stage 2 out — 1.0, stage 3 out — 1.5, stage 4 in — 2.5, stage 4 out — 2.0, economizer in — 1.5, condenser in — 1.5, and feedpump in — 0.23.

On the air side, the ducts for economizer and burner blower outlets are 2.5-in. inside diameter with 0.010-in. walls. The exhaust pipe to the rear of the vehicle is rectangular and is 6-in. wide, 2-in. high, and has 0.040-in. thick walls.

The ducting connections on the steam side are sealed with pinched metal gaskets such as the well-known ConFlat seals. These seals are such that plastic flow of the gasket due to steam pressure forces an even tighter seal.

All ducting is mild steel except for the superheater out and the steam ducting between stages, which are low-alloy chrome-moly steel. The total steam and air ducting weight is calculated to be 29 lb.

Sealing and Air Ejection

Static seals use metal ConFlat seals, as discussed above. There are also three dynamic seals: at each end of the expander crankshaft, and at the throttle shaft. These are double metal seals impregnated with the dry lubricant. The space between the double seals is vented to the condenser inlet. In this way, air leakage in is sent directly to the air ejector pump and steam leakage out is reclaimed.

Any air leakage into the system concentrates in the upper condenser manifold. A bleed line from this manifold passes this steam/air mixture to a separate small condensing coil where the steam is condensed. A small trap downstream then separates the water from the air and returns the former to the condenser hotwell and delivers the air through a backflow check valve to a small positive-displacement air ejector pump. A float valve in the trap prevents water from entering the pump. The pump is belt-driven off the expander by means of pulley 28 (FIG. 6). The pump has a capacity of about 2 $ft^3$/min at a pressure differential of about 10 psi. Therefore, any air accumulated in the system during shutdown is exhausted in about 10 seconds.

The air ejector pump, condensing coil, and trap are estimated to weigh about 10 lb.

Insulation

Some insulation is required to maintain calculated system efficiencies, to permit rapid restarts after short downtimes, and to delay freezing. The insulation chosen is an inexpensive type adopted from the space program. The hot component is wrapped with several layers of thin mild steel in which is stamped a regular pattern of dimples or pleats, such as a waffle pattern, which protrude on one side only about 0.02 - 0.06-in. The layers thereby being spaced off from each other provide insulation by the air pockets within and by the long conduction paths in the metal. This insulation can be used at any temperature in the engine.

Corrosion Protection

Corrosion protection is achieved by first using a neutralized and purified water working fluid, second by continually ejecting leakage air from the steam side of the system, third by passivating the steam parts in the low temperature regions of the system, and fourth by coating the steel parts as required in the high temperature regions with a film of dry lubricant on the steam side and a film of suitable ceramic, such as $Al_2O_3$, on the air side.

Maintenance

The only routine maintenance items are: (1) checking the control system null temperatures and adjusting by means of three variable resistors; (2) checking the precompressed spring in the feedpressure control and adjusting by means of a setscrew; (3) cleaning the magnetic plug in the expander to remove wear particles; (4) hosing down the condenser from the inside to remove bugs and dirt; and (5) checking the working fluid level and topping up with distilled, deionized water with lubricant. Occasional belt and shaft seal replacement may also be needed. There are no oil changes, or any need for antifreeze, or plug and point replacements.

Accessory Drives

There are three belt drives in the system: The first encompasses the combined starter/generator, burner blower, and feedpump. The last has a slip clutch which deactivates it when the thaw system is used (and also assists the thaw process with friction heat). The second connects the starter/generator to the expander by means of a steam-pressure actuated clutch. The third connects the air ejector pump to the expander. The fuel pump is electrically driven.

Starting and Shutdown

The normal starting sequence is as follows: (1) Key "on." Control system activated. (2) Key switched to "start." Glow plug activated. The fuel pump, starter motor, feedpump, and burner blower begin turning. Combustion begins. (3) The feedwater slowly recirculates back to the feedpump inlet through a trap at the superheater discharge (the trap also serves as a plenum for quick response and for feedpressure control) until steam pressure forms. Rising steam pressure engages the clutch between the expander and starter motor and the expander begins turning, primarily on its own. The vehicle can now be driven at low power. The calculated starting time at 35° F is about 25 seconds, which is comparable to contemporary internal combustion engines with air-pollution devices. In less than one minute, the vehicle can be driven at full power. Restarting times and starting times in hotter weather are even less than above.

The rapid starting time is due to the low water inventory in the steam generator (about 2 pounds) and the moderate steam generator core weight (25 pounds). It is aided by a bypass in duct 22 (FIG. 6) which allows the burner air to bypass the economizer during starting. The bypass valve closes once the expander begins turning.

For shutdown, the key is switched to "off" and the fuel pump stops. The throttle valve is fully closed by a solonoid to retain the steam pressure. Also, the hot air is trapped in the air side of the system because the economizer inlet and exhaust pipe discharge at at low point in the air circuit. These features permit rapid restarts.

This completes the detailed description of the system. Its calculated weight, volume, and performance are now presented below.

System Weight, Volume, and Performance

Weight

The weight of all components described above to which weights have been stated comes to a total of 341 pounds. To this must be added the starter/generator (15 lb. estimated), battery (40 lb. estimated), and the water (8 lb. calculated). The total system weight is therefore 404 pounds. To be prudent, a miscellaneous component weight of 50 lb. is added, which brings the total for all components forward of the driveshaft required to propel the vehicle to 454 pounds, or 4.54 lb/bhp. This value is about the same as, or somewhat less than, most internal combustion engines. It is far less than other, otherwise successful, automotive steam engines tried to date.

Volume

The bulk rectangular dimensions of the engine shown in FIGS. 6, 7, and 8 are: 22-in. high, 24.3-in. wide, and 32-in. deep. The depth could be reduced by moving the condenser rearward, but this would reduce maintenance access. The engine bulk volume enclosing these dimensions is 9.9 cubic feet, or 0.099 lb/bhp. Because this volume is readily available is automobiles weighing 2000 lb, much less the 3000 lb vehicle being considered here, it is clearly evident that the engine of the present invention can easily fit into any engine compartment that can accommodate an internal combustion or diesel engine.

Performance

Figure 10:
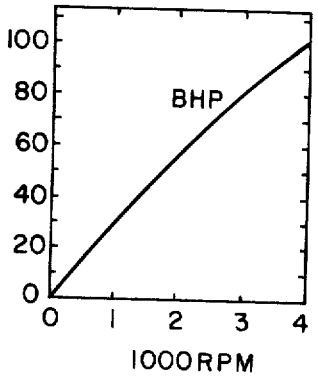
FIG. 10 is a diagram showing calculated net power vs. engine speed for the example engine of FIG. 6.

Brake horsepower as a function of expander speed is shown in FIG. 10. The curve is slightly nonlinear because blower power and a portion of the expander friction increase with $rpm^2$ while indicated horsepower increases linearly with rpm. The power peak is 100 bhp at 4000 rpm.

To reduce total engine size and cost, the expander is coupled to a torque convertor and two-speed transmission. The torque convertor characteristics are as follows: 1000 rpm maximum expander speed at standstill; 4 to 1 maximum torque multiplication. From these characteristics, torque convertor efficiencies can be determined. The two-speed transmission operates only in high gear unless two conditions are met: (1) the operator foot pedal is depressed to more than half-way to the floor, and (2) the vehicle speed is below 40 mph. In the full power mode, the shift point is at 4000 rpm, which corresponds to 50 mph in first gear. In second or high gear, the expander specific speed is 20 mph per 1000 rpm. In cruise mode, the drivetrain efficiency between the expander output shaft and the drivewheels is taken to be 87 percent.

Figure 11:
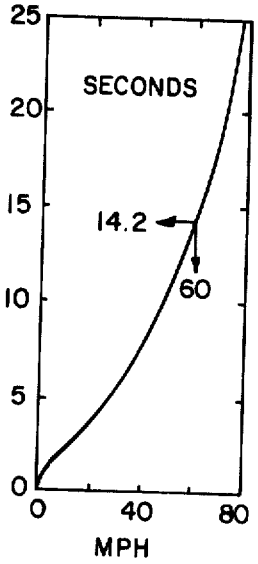
FIG. 11 is a diagram showing calculated time-to-speed for the example engine of FIG. 6 when installed in a 3000 lb. vehicle.

The calculated full power acceleration curve is shown in FIG. 11 for the engine installed in a 3000 lb. vehicle. Zero-to-60 mph time is 14.2 seconds and 0 to 80 mph time is 27 seconds, both of which allow one second for expander acceleration. These figures appear to be so much more than adequate that further reductions in engine size may be possible. The calculated grade-climbing ability of the vehicle at full power is as follows: 45.4 percent at 10 mph, 29.7 percent at 20 mph, 20.9 percent at 40 mph, 17.7 percent at 50 mph, 10.4 percent at 50 mph (gear 2), 9.6 percent at 60 mph, and 5.4 percent at 80 mph.

Figure 12:
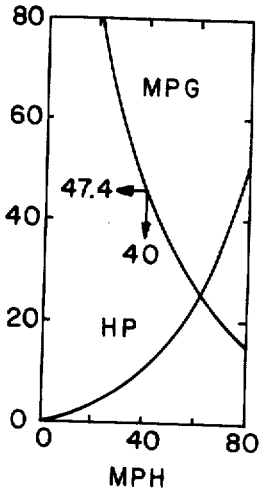
FIG. 12 is a diagram showing calculated required road horsepower at cruise speed and the resulting fuel consumption plotted against cruise speed for the example engine of FIG. 6 when installed in a 3000 lb. vehicle.

The calculated cruise mode fuel economy is shown in FIG. 12 for gasoline (20,000 BTu/lb lower heating value), which is used here to facilitate direct comparison with internal combustion engines. This fuel economy curve is based on the required cruise road horsepower curve also shown in FIG. 12. Note that, because engine efficiency varies little with speed, the fuel economy is very sensitive to speed, which should provide an economic incentive to drive slowly. Typical fuel economy values are: 80.7 miles per gallon (mpg) at 20 mph, 47.4 mpg at 40 mph, 26.5 mpg at 60 mph, and 15.5 mpg at 80 mph. The remarkable value of 80.7 mpg at 20 mph is possible if combustion is complete at such low flow rates, which may require cycled combustion. Other fuels will produce different fuel consumptions depending upon their heating values.

The fuel consumption curve in FIG. 12 does not include power drains from the generator and fuel pump, both of which should be negligible. However, because a conservatively-high estimate of friction coefficient of 0.2 was used in the expander friction analysis and because no account was taken of the partial recovery of friction loss by passing the expander exhaust steam through the crankcase, these fuel economy figures may even be slightly low.

SUMMARY

This completes the description of the thermodynamic cycle of the present invention and the example engine, the latter of which has been presented in considerable detail to show that the disclosed cycle can be attractively reduced to practice.

it should be clear from the above detailed description that the objectives presented at the beginning of this disclosure have been more than adequately met. In summary, a new thermodynamic cycle has been disclosed which is specifically tailored to the requirements of air-cooled vehicular engines. Also, an example engine employing the disclosed cycle has been presented in detail. This engine has been shown to weigh the same or less than equivalent internal combustion engines and therefore mass-production costs should be the same or less. However, it is virtually pollution-free; it can burn a wide variety of fuels including liquid/solid slurries, thereby relieving our dependence on petroleum fuels; it can burn mixtures of different fuels at the same time; its efficiency and fuel economy at low loads exceeds that of internal combustion engines and even some diesels; and it is virtually noise-free. Furthermore, the engine's acceleration and response, with a less-complicated transmission, is as good as an internal combustion engine. It can have zero idle and coast fuel consumption by virtue of the steam generator thermal mass; and it requires no costly and tempermental pollution-control devices. Its starting time is about the same as engines with these devices.

For concreteness, the present invention has been described and illustrated with specific embodiments. However, numerous changes and modifications may be made without departing from the spirit and scope of the invention. Examples of such changes and modifications are: the use of more or less expansion and/or reheat stages, other working fluids and expanders, other means of control, other accessories, and other means of heat addition.

Having described my invention, I now claim:

1. An integrated process for producing power from fuel and combustion inlet air comprising a Rankine-type thermodynamic cycle in which the thermodynamic working fluid is water, said thermodynamic cycle including the steps of pressurizing the water in liquid state, vaporizing the water to a superheated vapor by transferring to it the heat resulting from the combustion of fuel and air, expanding the heated vapor in a series of thermodynamic work-producing stages in which the volume expansion ratio of the last stage is less than four-to-one, reheating the vapor between each of said thermodynamic expansion stages so that said vapor after exiting the last expansion stage is superheated to a temperature of at least 350° F, desuperheating said superheated vapor after expansion by transferring all of its superheat energy to said air for combustion, condensing said desuperheated vapor back to liquid so as to repeat the cycle by transferring all of its vapor energy to ambient air, and extracting a portion of ambient air, after being heated by said condensing fluid for use as said air.

2. An external-combustion system for producing power from fuel and combustion inlet air comprising the combination of: water as the working fluid, means for heating said fluid from liquid to superheated vapor by transferring to it the heat generated from the combustion of said fuel and air, throttle means for controlling the pressure of said fluid after heating to said superheated vapor, means for expanding said fluid in a series of power-producing expansion stages with the volume expansion ratio of the last said stage being less than four-to-one, means for reheating said fluid between said thermodynamic expansion stages to superheat the vapor exiting the last expansion stage to a temperature of at least 350° F, means for desuperheating said fluid after said final expansion by transferring all of its superheat energy to said combustion air and thereby preheating said air, means for condensing said desuperheated fluid back to liquid so as to repeat the flow circuit just described by transferring all of the vapor energy of the fluid to the ambient air, and means for extracting a portion of said ambient air, after exiting said condensing means, for use as said combustion air.

3. A power-producing system of claim 2 in which the working fluid temperature exceeds 700° F, a mixture of solid, powdered lubricant is mixed with said working fluid, and means for circulating said lubricant with said fluid throughout all of the fluid flow circuit of said power system for lubricating surface in contact with the working fluid.

4. The power-producing system of claim 2 in which the cooling means for condensing said working fluid includes water and in which said inlet combustion air is unheated ambient air.

5. The power-producing system of claim 2 which includes negative feedback means for controlling the primary vapor pressure and temperature, combustion temperature, and condensate temperature.

* * * * *